US005738558A

United States Patent [19]

Zimmer et al.

[11] Patent Number: 5,738,558

[45] Date of Patent: Apr. 14, 1998

[54] MOTOR FOR TOY CONSTRUCTION SYSTEM

[75] Inventors: John Zimmer, Blue Bell; Michael DiLabio, Limerick, both of Pa.

[73] Assignee: Connector Set Limited Partnership, Hatfield, Pa.

[21] Appl. No.: 795,013

[22] Filed: Feb. 5, 1997

[51] Int. Cl.[6] ..... A63H 33/04

[52] U.S. Cl. ..... 446/90; 446/85

[58] Field of Search ..... 446/90, 91, 85

[56] References Cited

U.S. PATENT DOCUMENTS

| | | | |
|---|---|---|---|
| 3,484,983 | 12/1969 | Fischer | 446/90 |
| 4,044,497 | 8/1977 | Bettens | 446/96 |
| 4,109,398 | 8/1978 | Hida | 35/13 |
| 4,566,169 | 1/1986 | Vesely | 29/560 |
| 4,813,903 | 3/1989 | Furukawa et al. | 446/90 |
| 5,199,919 | 4/1993 | Glickman . | |
| 5,241,875 | 9/1993 | Kochanneck | 74/479 |
| 5,346,420 | 9/1994 | Glickman | 446/126 |

*Primary Examiner*—Robert A. Hafer
*Assistant Examiner*—Laura Fossum
*Attorney, Agent, or Firm*—Schweitzer Cornman Gross & Bondell LLP

[57] ABSTRACT

A motor for a toy construction set of the type having a plurality of connector elements and rod-like struts engageable with the connector elements to form a coherent structure wherein the connector elements have a center hub portion and a plurality of pairs of spaced-apart gripping arms adapted for lateral, snap-in engagement of the struts. The motor has a housing body and a plurality of sets of projections extending from the housing body, each of which is adapted for tight frictional engagement with a plurality of activities of the connectors. The sets of projections are located such that a connector mounted thereon can be interconnected, by said connectors and struts, to a connector mounted on another set of projections so the motor can be rigidly incorporated in an assembly comprised of a combination of the connectors and struts of the toy construction set.

10 Claims, 4 Drawing Sheets

FIG. 1
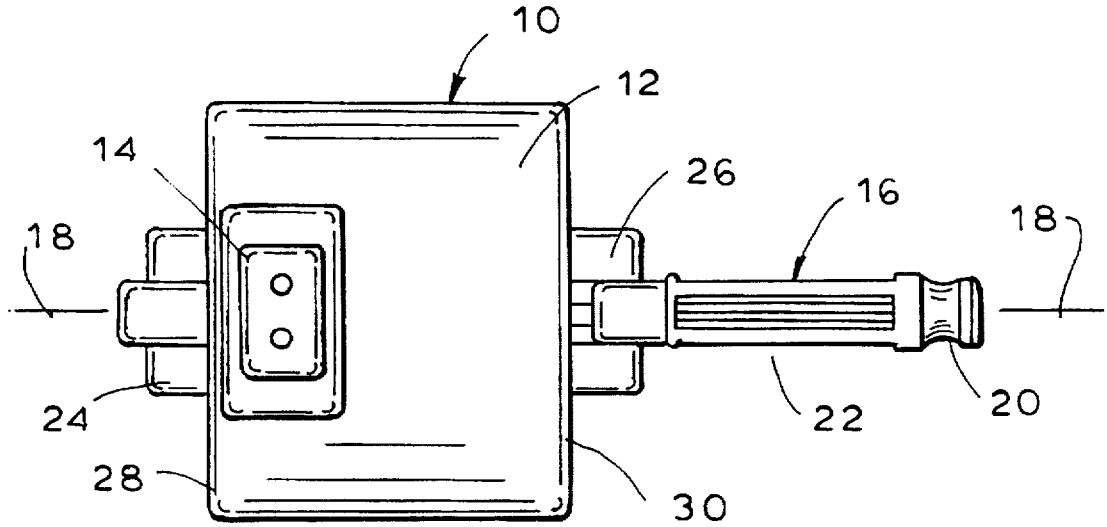
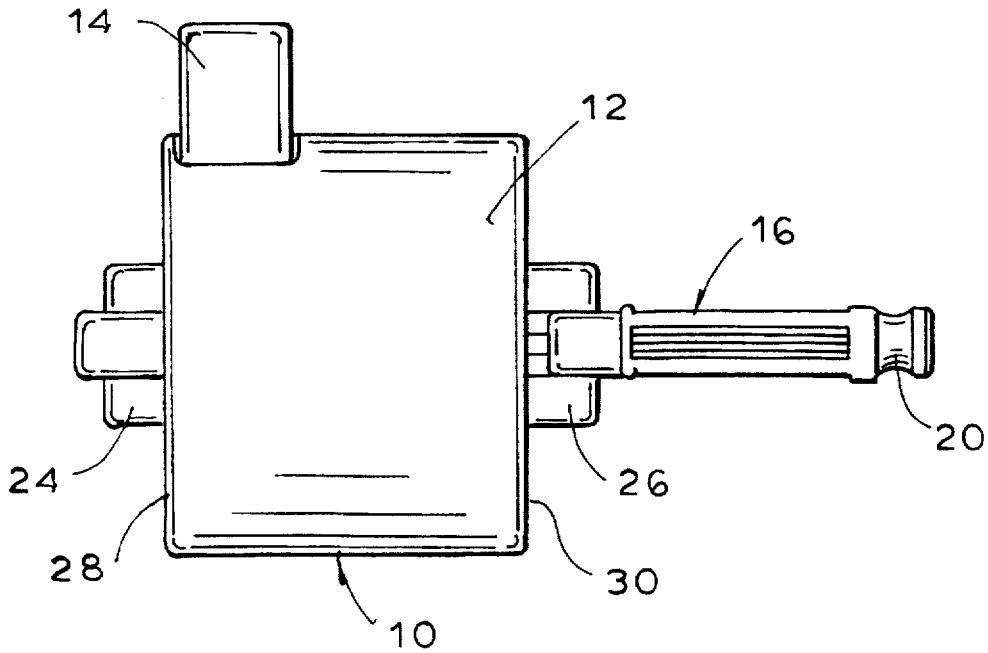
FIG. 2

MOTOR FOR TOY CONSTRUCTION SYSTEM

BACKGROUND AND SUMMARY OF THE INVENTION

The present invention is directed to a toy construction system, and in particular, a motor which may be incorporated in such a toy construction system.

The motor of the present invention is designed to be used with a toy construction system comprised of an assembly of connector elements and structural elements which can be combined in various forms to form composite structures. U.S. Pat. Nos. 5,061,219, 5,137,486 and 5,199,919 to Glickman, the disclosures of which are herein incorporated by reference, disclose such a toy construction system. The toy construction system includes a plurality of hub-like connector elements and rod-like strut elements which can be combined in various forms to create rigid skeletal structures. As will be further described below, the connectors of this system include gripping arms adapted for lateral, snap-in engagement of the struts and include cavities disposed radially around a center hub portion between the hub portion and the gripping arms.

The motor of the present invention includes a housing body with a plurality of sets of projections extending from the body. Each projection is adapted for tight frictional engagement with one of the cavities of the connectors and the sets are located such that a connector mounted thereon can be interconnected with a connector mounted on another set of projections. The housing body is preferably cylindrical and has an output shaft extending from one end and along the center axis. The sets of projections are located on the opposite ends of the cylindrical housing body and are disposed radially about the center axis. The projections are located such that two connector elements can be mounted on opposite sides of the housing body. When mounted, one connector is disposed over the output shaft such that the two connectors and the output shaft are all substantially coaxial.

The known hub-like connector elements have a plurality of generally radially oriented sockets for receiving and lockingly engaging end portions of the struts. Specifically, the connectors include a plurality of spaced-apart gripping arms disposed radially around a center hub portion. The gripping arms define socket-forming recesses adapted for lateral snap-in insertion of the struts. Additionally, the end extremities of the struts are formed with an annular groove, defining a flanged end such that the strut is locked against axial and lateral withdrawal from the connector once installed.

As described in the above-mentioned patents, and specifically U.S. Pat. No. 5,199,919, the connectors are provided in various configurations including a planar "snowflake" configuration having eight sockets disposed radially 360 degrees around, and equidistant from, a center hub portion. Also disclosed is a multiplanar, composite connector formed of two connectors, each including a special recess adapted such that the two connectors can be assembled in a 90 degree relationship to one another.

Once releasably mounted on the motor housing body, the connectors can be connected to each other and/or to other elements of a larger structure. Thus, the motor of the present invention can be incorporated in an assembly comprised of a plurality of struts and connectors and can be used as a power source for such a structure.

BRIEF DESCRIPTION OF THE DRAWINGS

For a more complete understanding of the above and other features and advantages of the invention, reference should be made to the following detailed description of a preferred embodiment of the invention and to the accompanying drawings, wherein:

FIG. 1 is a top plan view of the motor;

FIG. 2 is a side elevational view of the motor of FIG. 1;

DESCRIPTION OF THE PREFERRED EMBODIMENTS

Figure 3:
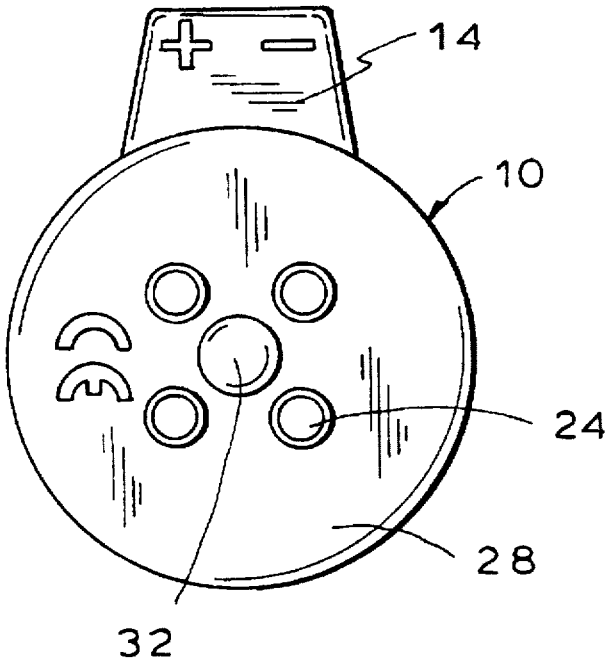
FIG. 3 is an end elevational view of the motor of FIG. 1.

Referring now to the drawing, and initially to FIGS. 1 and 2 thereof, the motor 10 of the present invention has a housing body 12 which is preferably cylindrical in shape. An outlet 14 of the motor is disposed on the side of the housing body 12 for connecting the motor 10 to a power source (not shown). An output shaft 16 extends from the housing body 12 and is preferably coaxial with the center axis 18 of the housing body 12. The output shaft 16 preferably has an end portion 20 and a length 22 sized and shaped like a strut element of the above-mentioned toy construction set such that the connector elements and gears thereof can be readily attached to the output shaft 16. First and second sets of projections 24, 26 extend from opposite ends 28, 30 of the housing body 12 for attachment of connector elements.

Figure 4:
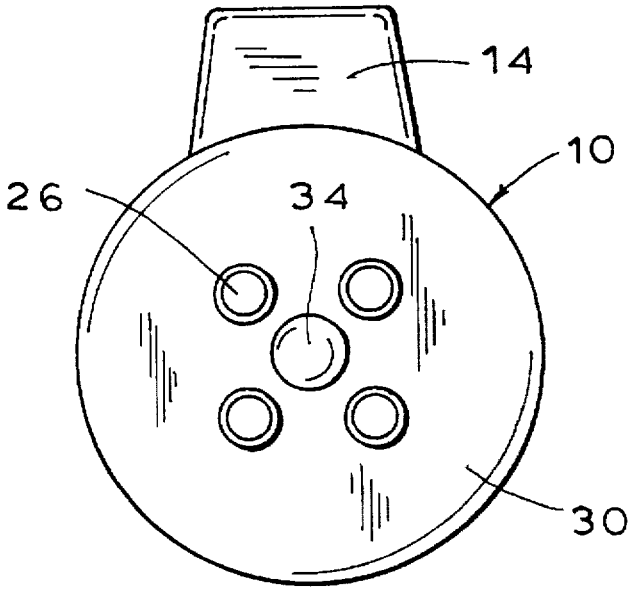
FIG. 4 is an end elevational view of the motor of FIG. 1.

Referring to FIGS. 3 and 4, the first and second sets of projections 24, 26 are disposed radially around the centers 32, 34 of the ends 28, 30 of the housing body 12. Also, the projections 24, 26 are preferably spaced substantially equidistant from the centers 32, 34.

Figure 6:
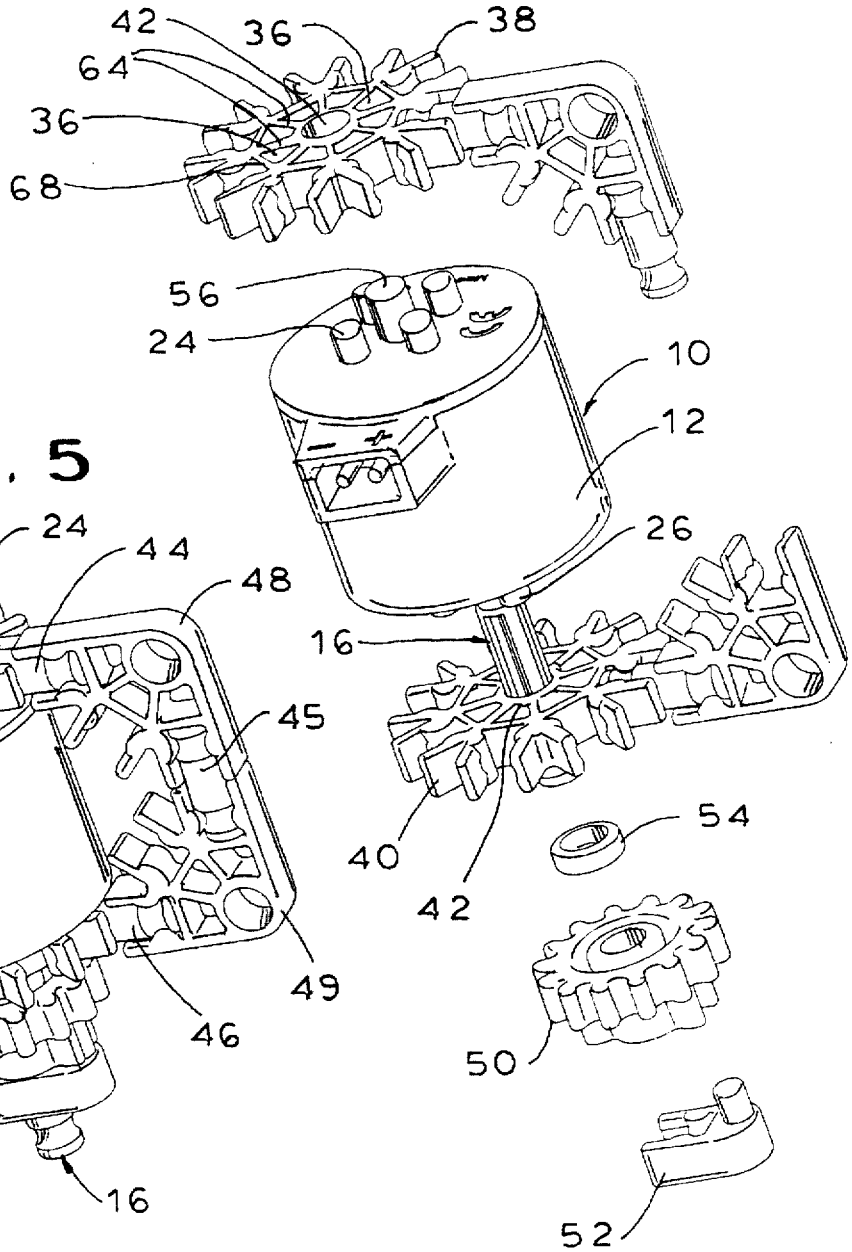
FIG. 6 is a an exploded, perspective view of the assembly of FIG. 5.
Figure 5:
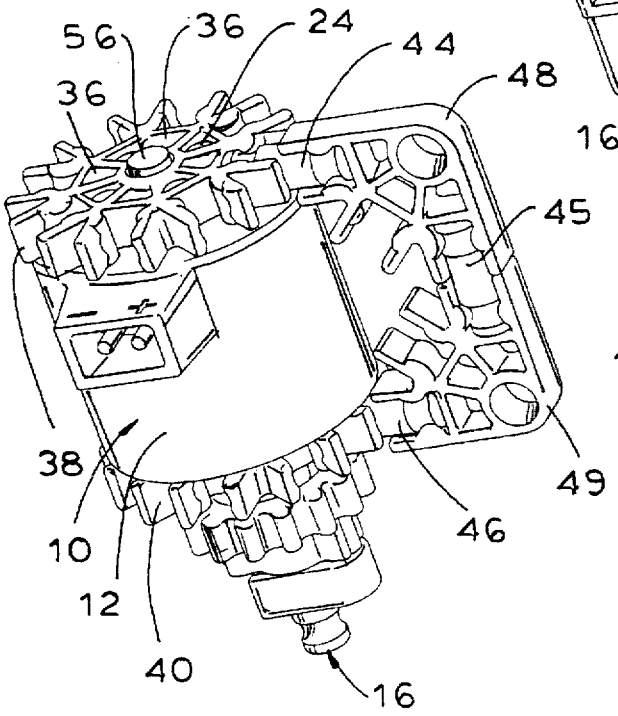
FIG. 5 is a perspective view of an assembly incorporating the motor of FIG. 1.

Referring to FIGS. 5 and 6, the projections of the first and second sets thereof 24, 26 are sized and shaped to tightly frictionally engage cavities 36 of the connectors 38, 40 of the toy construction set. Additionally, the projections are aligned such that the connectors 38, 40 can be mounted thereon such that the connectors 38, 40 are rigidly, but releasably attached to the motor 10. As best seen in FIG. 6, the projections of the second set thereof 26 are aligned such that, when the connector 40 is mounted to the housing body 12, the output shaft 16 extends through and is substantially coaxial with a hub section 42 of the connector 40. Additionally, the first and second sets of projections 24, 26 are aligned such that, when mounted, the connectors 38, 40 are coaxial with one another and with the output shaft 16.

When mounted, the connectors 38, 40 can be interconnected to one another using struts 44, 45, 46 and connectors 48, 49 and can be connected to larger assembly using similar struts and connectors of the toy construction set. Preferably, the housing body 12 has a diameter which is not greater than the diameter of the connectors 38, 40 such that the housing body 12 will not interfere with elements such as the connectors 48, 49 oriented as shown. Also, preferably, the housing body 12 has an axial length which is substantially equal to and integer multiple of the diameter of the connectors 38, 40 less a width thereof such that, when mounted on the motor 10, the connectors 38, 40 can be easily interconnected with elements of the toy construction set. In the embodiment depicted, the housing body 12 has an axial length of about one diameter of the connectors 38, 40 less a width thereof. Thus, the mounted, connectors 38, 40 can be interconnected using the shortest strut elements 44, 45, 46 and connectors 48, 49.

As mentioned, preferably the output shaft 16 has a shape similar to that of the strut elements of the toy connector set. Thus, torque-transferring elements, such as the gear 50, locking connector 52 and washer 54 can be mounted on the output shaft 16 for use in powering a larger structure. The motor 10 also includes a center projection 56 extending along the center axis of the housing body 12. The center projection preferably extends beyond the projections of the first set 24 and preferably beyond the connector 38 mounted thereon.

As best seen in FIG. 6, the connector elements 38, 40 of the toy construction set have spoke-like radial walls 64 extending from the hub section 42 to the gripping arm 66. The outward ends of adjacent radial walls 64 are connected by web section 68, each of which forms an inner wall of one of the socket-forming recesses and forms an outer wall of one of the cavities 36. Thus, the cavities 36 are each bounded by the hub section 42, a pair of adjacent radial walls 64 and a web section 68.

The strut elements are provided in several, predetermined lengths such that in a system of "n" different lengths, the length of each strut is determined according to the formula:

$L_x=(1.414)^{(x-1)} * D_{min}-(2*d)$, where $L_x$=the length of the $x^{th}$ strut of a series of 1 to "n", $D_{min}$=the spacing between hub axis of two connector elements joined by the shortest strut element of the series, and d=the distance from the hub axis to the end wall of the socket-forming section.

Figure 7:
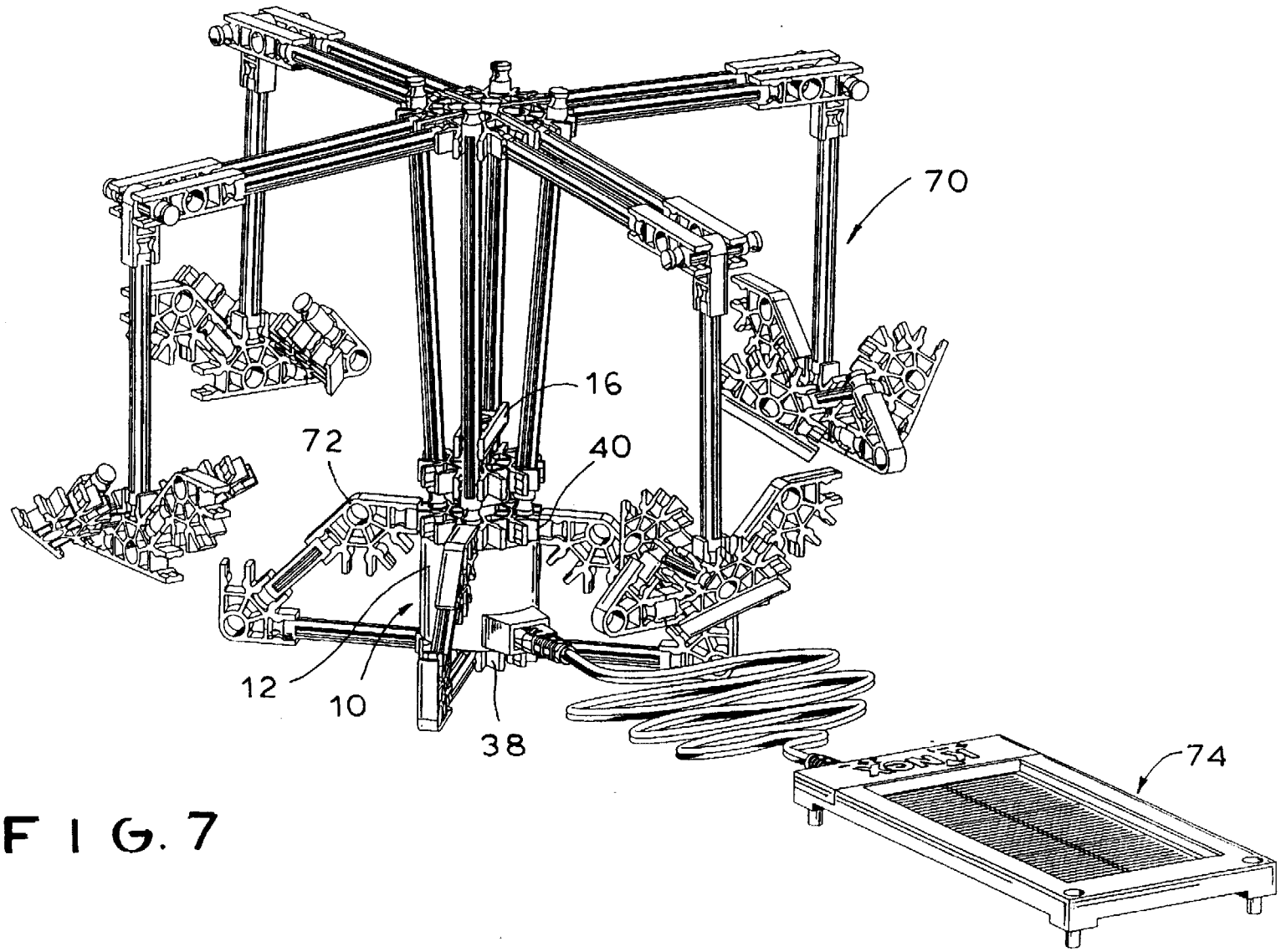
FIG. 7 is a perspective of the motor of FIG. 1 incorporated in a larger structure and connected to a power source.

Referring to FIG. 7, it will be appreciated that the motor 10 of the present invention can be incorporated in a larger structure 70 (for example a rotating swing) comprised of an assembly of strut and connector elements of the toy construction set. Connectors 38, 40 can be interconnected forming a base 72 for the structure 70. In addition, the motor 10 can form a load-bearing portion of the base 72. The motor 10 can be powered by a photovoltaic cell 74 as depicted, or any other suitable power source.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A motor assembly for use in combination with a toy construction set, comprising:

(a) a housing body having opposed ends;

(b) a motor within said housing body comprising an output shaft aligned with a center axis of said housing body and extending through a first end of said opposed ends;

(c) the toy construction set being of the type having a plurality of connector elements and rod-like struts engagable with said connector elements to form a coherent structure wherein said connector elements have a center hub portion with a plurality of pairs of spaced-apart gripping arms disposed radially there around defining socket-forming recesses adapted for lateral snap-in engagement of said struts, and wherein said connector elements have cavities disposed radially around said hub portion between said hub portion and said socket-forming recesses;

(d) a plurality of sets of projections extending from said opposed ends of said housing body including a first set of projections disposed around said output shaft and spaced radially therefrom, each projection of said sets thereof being adapted for tight frictional engagement with one of said cavities of said connector elements; and (e) said projections of each set being located such that a first of said connector elements mounted thereon is adapted to be interconnected, by another of said connector elements and said struts of said toy construction set, to a second of said connector elements mounted on another of said sets of projections.

2. A motor assembly as in claim 1, wherein:

(a) said plurality of projections further include a second set of projections on the other of said opposed ends disposed around the center axis of the housing body and spaced radially therefrom; and (b) said connector elements, when mounted on the projections, are removably fastened to said motor housing.

3. A motor assembly as in claim 2, wherein said first set of projections are aligned such that the hub of said first connector element mounted thereon is disposed around and aligned substantially coaxially with said output shaft.

4. A motor assembly as in claim 3, wherein said first and second sets of projections are aligned such that the hub portion of said first connector element mounted on said first set of projections and the hub portion of said second connector element mounted on said second set of projections are aligned substantially coaxially.

5. A motor assembly as in claim 4, wherein said housing body is cylindrical and has a diameter not greater than a diameter of said connector elements.

6. A motor assembly as in claim 5, wherein:

(a) said housing body has an axial length dimension between said first and second opposed ends substantially equal to an integer multiple of said diameter of said connector elements less a width thereof such that said first and second connector elements mounted on said first and second sets of projections, respectively, have centers spaced at a distance substantially equal to said integer multiple of said diameter of said connector elements; and (b) whereby said first and second connector elements mounted on said first and second sets of projections are adapted to be interconnected to each other by other of said connector elements and struts of said toy construction set and incorporated in an assembly comprised of other said connector elements and struts.

7. A motor assembly as in claim 6, wherein said length of said housing body is substantially equal to one diameter of said connector elements less said width thereof.

8. A motor assembly in claim 7, wherein:

(a) said second set of projections further comprises a fixed center projection extending from said second surface;

(b) said center projection is aligned with said axis of said housing body and is adapted to extend through said hub portion of said second connector element; and (c) said center projection has a length greater than said width of said connector such that, when said second connector element is mounted don said second set of projections and adjacent said second surface, said center projection extends beyond said second connector element.

9. A motor assembly as in claim 1, wherein said first set of projections are aligned such that the hub portion of said first connector element mounted thereon is disposed around and aligned substantially coaxially with said output shaft.

10. A motor assembly as in claim 1, wherein:

(a) said housing body has an axial length dimension between said first and second opposed ends substantially equal to an integer multiple of said diameter of said connector elements less a width thereof such that said first and second connector elements mounted on said first and second sets of projections, respectively, have centers spaced at a distance substantially equal to said integer multiple of said diameter of said connector elements; and (b) whereby said first and second connector elements mounted on said first and second sets of projections are adapted to be interconnected to each other by other of said connector connector elements and struts of said toy construction set and incorporated in an assembly comprised of said other connector elements and struts.

* * * * *